United States Patent [19]

Burton

[11] 4,318,559

[45] Mar. 9, 1982

[54] LOCK FOR SLIDING MEMBERS

[75] Inventor: Carl Burton, Denver, Colo.

[73] Assignee: Johnston & Margolis, P.C., Broomfield, Colo.

[21] Appl. No.: 135,338

[22] Filed: Mar. 31, 1980

[51] Int. Cl.[3] ..... E05C 17/32

[52] U.S. Cl. ..... 292/263; 70/93

[58] Field of Search ..... 292/DIG. 46, 263, 338; 70/93

[56] References Cited

U.S. PATENT DOCUMENTS

| | | | |
|---|---|---|---|
| 924,081 | 6/1909 | Loev | 292/263 |
| 2,103,004 | 12/1937 | Halinka | 292/263 |
| 3,499,675 | 3/1970 | Isenberg | 292/263 |
| 4,045,982 | 9/1977 | Gorton et al. | 292/DIG. 46 X |
| 4,070,049 | 1/1978 | Brewer | 292/263 |

FOREIGN PATENT DOCUMENTS

| | | | |
|---|---|---|---|
| 202213 | 6/1907 | Fed. Rep. of Germany | 292/263 |

*Primary Examiner*—Richard E. Moore

*Attorney, Agent, or Firm*—H. Kenneth Johnston, II; Donald W. Margolis

[57] ABSTRACT

An automatic lockable linkage system for use with sliding members, such as a sliding door or window, comprising a first and second telescoping arm member pivotally interconnected adjacent to their inner end portions. Each telescoping arm member also has an outer end which is pivotally connectable to a fixed structure and a sliding member, respectively. When the sliding member is in the closed position, a lockable sliding linkage is automatically positioned over the pivotally interconnected inner end portions of the first and second telescoping arm members retaining the sliding member in the closed position.

9 Claims, 4 Drawing Figures

LOCK FOR SLIDING MEMBERS

BACKGROUND OF THE INVENTION

Sliding members, such as sliding glass doors and windows are usually equipped with a standard releasable lock which retains the door or window in a locked position. Such doors and windows are, however, notoriously easy to open from the outside, even though the standard lock is properly locked on the inside. Accordingly, there is a need for a lock for sliding doors and windows which will positively exclude unauthorized entries. Many attempts have been made to provide such a lock, but such attempts have been relatively unsuccessful. Locks presently available cause the loss of use of part of the opening of the door because of the mechanism. The locks available require the mechanism to be attached near the center of the door wherein the present invention, because of the hinging design, allows the device to be mounted at any height on the door. The devices available require a gravity feed situation in order for the lock to actuate such as in U.S. Pat. No. 3,563,592. Other devices, which are presently available, restrict the opening of the sliding member such as in U.S. Pat. No. 3,698,754, whereas the present invention, because of its unique folding characteristics, causes the loss of only a very minimal amount of the door opening when the device is in the collapsed position.

SUMMARY OF THE INVENTION

The present invention provides a lock for a sliding member such as a sliding glass door or window, which positively prevents opening of the door or window without the breaking of the door or window and additionally breaking the locking mechanism on the sliding lockable member, which generally overcomes all the disadvantages noted above with respect to prior art locks.

One feature of this invention is the use of a locking mechanism which acts between the telescoping arm members which center over the pivotal interconnected end portions of the first and second telescoping arm members automatically upon closing of the sliding member. The locking device may be prohibited from being removed from the center locked position by engaging the key lock mechanism which prohibits the use of the sliding member without use of a key to unlock the key lock mechanism and thus further preventing the unauthorized use of or entry to the premises without rather drastic destruction to the property.

The lockable sliding linkage can be most advantageously operated if one end of the telescoping arm is pivotally connected to a fixed structure and the end of the second telescoping arm is pivotally connected to the sliding member. With this arrangement, movement of the sliding member to the closed position automatically moves the pivotally connected telescoping arm members to the horizontal position whereby the lockable sliding linkage is automatically positioned over the center prohibiting further movement of the telescoping arm members in the upward or downward position. No additional or special action is necessary on the part of the user to place the lockable sliding linkage in position.

If a person desires to prevent small children or other parties who may be on the premises but not authorized to use the particular entry, the key locking mechanism may be engaged to further prevent the movement of the lockable sliding linkage and retaining the sliding member in the closed position.

The lock device of this invention is readily adapted for installation on existing sliding doors or windows according to the present invention. The outer end of the first telescoping arm member is mechanically attached to the fixed structure by the use of bolts or screws or other permanently fixing mechanisms with the second end of the telescoping arm member similarly affixed to the sliding member. This installation is thus a permanent type installation and further adds to the advantages of the sliding member wherein the lockable sliding linkage becomes a second handle or means of opening and closing the sliding door or window. Thus, with the present invention, the locking of the particular door or window is totally eliminated except by the use of the present invention.

In making the device more versatile, it is provided with a means for adjusting or telescoping length thereof. This permits the locking device to accomodate structures with different distance between the sliding member and the fixed structure.

These concepts can be advantageously embodied in a automatically locking device which includes a first and second telescoping arm member pivotally interconnected adjacent the inner end portions thereof and means for mounting the first and second telescoping arm members adjacent the outer end portions thereof to the slidable member and fixed structure respectively.

When the sliding member is in the closed position, the lockable sliding linkage is automatically positioned over the center of the pivotally interconnected inner end portions of the first and second telescoping arm members retaining the sliding member in the closed position.

The first and second telescoping arm members are automatically locked in the horizontal position by the lockable sliding linkage in response to movement of the sliding members to the closed position. Once in the closed position, the lockable sliding linkage must be manually moved so that the telescoping arm members may pivotally move in the upward or downward position, allowing the sliding member to open.

The invention can be best be understood by reference to the following description taken in connection with the accompanying illustrative drawing.

DESCRIPTION OF THE PREFERRED EMBODIMENTS

Figure 1:
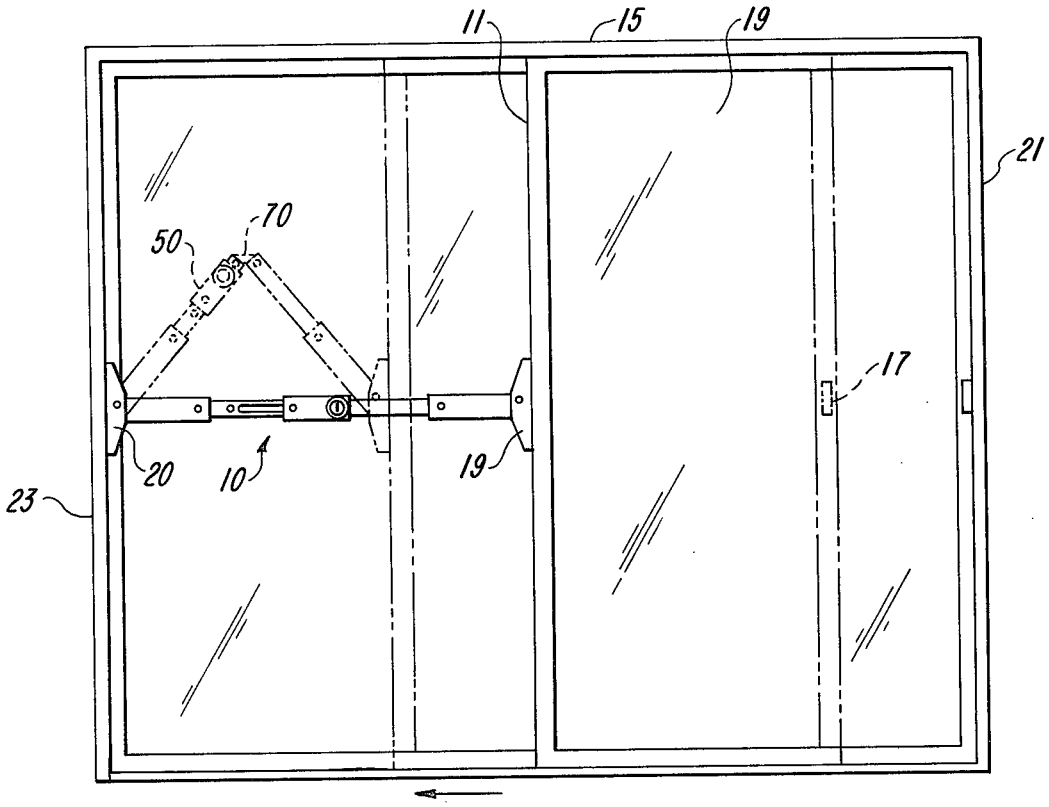
FIG. 1 is a side elevation view of the present invention showing the door in the open and closed positions.
Figure 2:
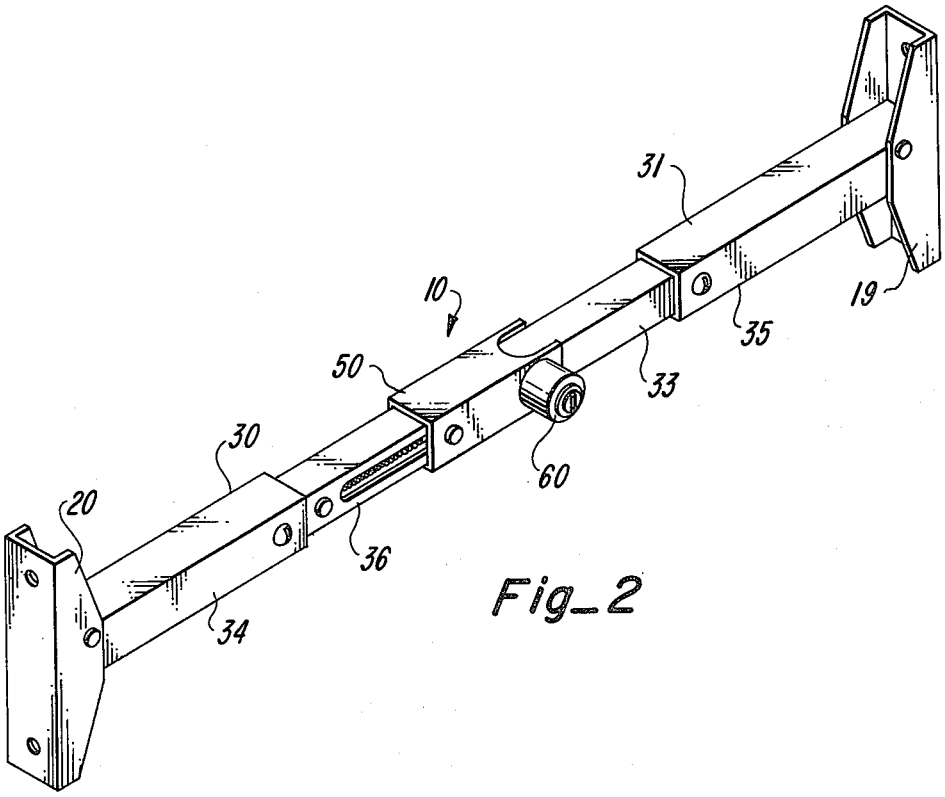
FIG. 2 is a plan view of the locking device constructed in accordance with the teachings of this invention.

FIG. 1 shows a lock 10 constructed in accordance with the teachings of this invention and acting between a sliding glass door 11 and a suitable fixed structure 13 such as a door jam or adjacent wall structure. The door 11 is illustrated both in the open and closed positions in FIG. 1. The door 11 is movable in the direction of the arrow to the open position when the lock 10 is in the released position. The door 11 may be of conventional structure and has a handle 17 which faces the interior of the construction defined by the wall structure 15. The door 11 slides in a conventional track (not shown) on the inside of an associated glass panel 19, and is therefore, an inside opening door. The glass panel 19 may be suitably mounted on the wall structure 15 in a conventional manner.

The end surface of the door 11 opposite the handle 17 constitutes an abutment 21. Similarly, the wall structure 15 defines an abutment 23 which is spaced from and confronts the abutment 21. The lock 11 in the locked position therefore is longitudinally rigid and acts between the abutments 21 and 23 to permit movement of the door 11 from the closed position to the open position.

Lock 10 generally comprises a pair of telescoping arm members 30 and 31 (FIGS. 3 and 4) pivotally connected by pivotal pins 72 and 74 to pivotal member 70 adjacent their inner end portions. End elements 20 and 19 are pivotally connected to the telescoping arm members 30 and 31 by pivotal means 25 and 22.

The telescoping arm means 30 comprises two sections 34 and 36 and telescoping arm means 31 comprises two sections 33 and 35. The telescoping arm member 30 has spring means 40 restrained by a spring restraint means 42 (FIGS. 3 and 4) connected to lockable slide linkage means 50 to spring means 40 by spring restraint means 52 wherein lockable slide linkage means 50 may be moved in the direction of arrow from over the center of the pivotal member 70 along a slide guide means 44 allowing the lock 10 to be moved to the open position as shown in FIG. 3.

Figure 4:
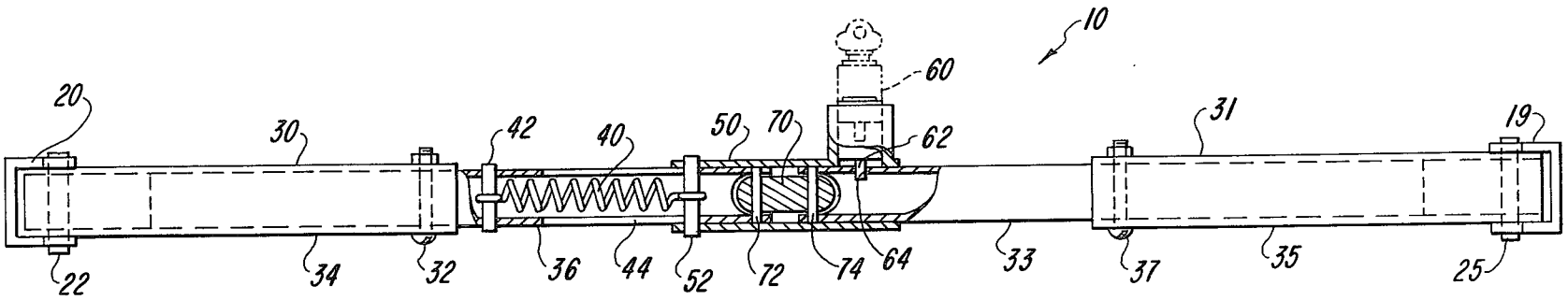
FIG. 4 is a top plan view of the present invention with the key-lock mechanism in the unlocked position and the sliding lockable means in the closed unlocked position.

Key lock means 60, having a locking pin means 62 is shown in FIG. 4 in both the open and closed position. In the closed position, locking pin means 62 protrudes into telescoping arm member 33 prohibiting pivotal member 70 from being actuated to open the door. Locking pin means 62 in the locked position extends into telescoping arm member 33 through port 64. End element 20 is mechanically fastened to fixed structure 15 and end element 19 is mechanically affixed to sliding member 11.

In operation lock 10 is opened by manually moving lockable sliding linkage means 50 from over the center of pivotal member 70 toward and along the slide guide means 44 until pivotal member 70 is free to move permitting telescoping arm members 30 and 31 to be raised or lowered from the horizontal position moving sliding member 11 towards the open position whereby the motion of lockable slide linkage means compresses spring means 40 against spring restraint means 42 which stays in that position until telescoping arm members 30 and 31 are again in the horizontal position at which time lockable slide linkage means 50 automatically positions itself over the pivotal member 70 and the inner end portions of arm members 33 and 36.

Figure 3:
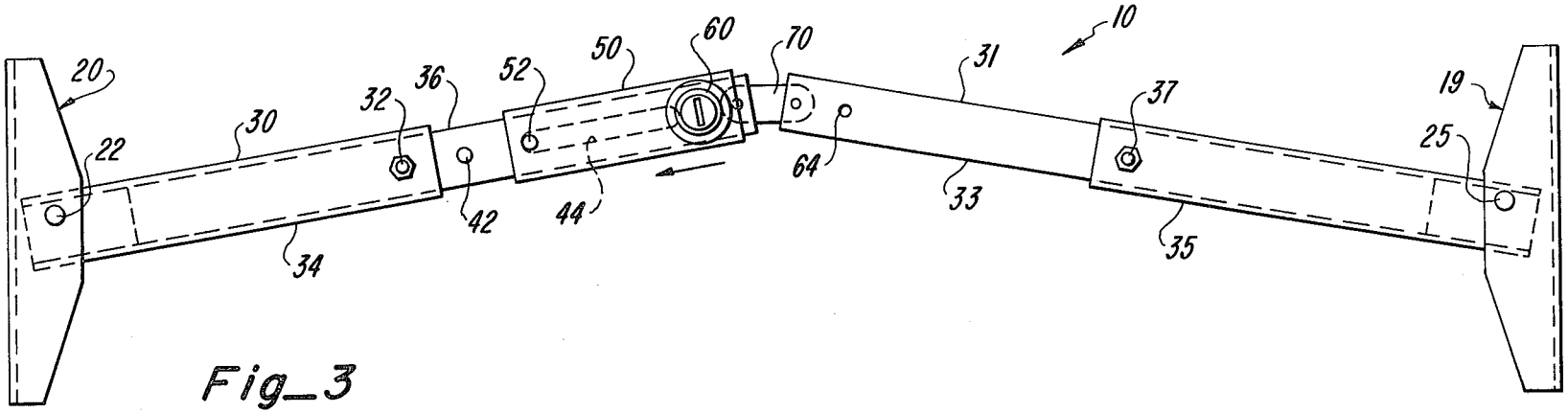
FIG. 3 is a side elevational view of the lock in the open position.

As lock 10 is moved to the open position as shown in FIG. 3, telescoping arm members 30 and 31 pivot on pivot pins 22 and 25, allowing lock means 10 to fold into a very tight compressed means allowing sliding member 11 to be opened to nearly its full extent.

Telescoping arm means 30 and 31 and telescoping restraint means 32 and 37 constitute variable link means for adjusting the overall length of lock 11. By loosing telescoping restraint means 32 and 37, telescoping arm members 30 and 31 may be telescoped or moved axially relative to each other to adjust the length of lock 10. When the desired length has been obtained, the telescoping restraint means 32 and 35 are tightened to prevent further telescoping movement of arm member 34 and 36 of telescoping arm member 30 and arm members 33 and 35 of telescoping arm member 31.

Telescoping arm members 30 and 31 are constructed of square tubular type material and in a manner allowing arm member 36 to slide into arm member 34 and arm member 33 to slide into arm member 35 of telescoping arm members 30 and 31 respectively as shown in FIGS. 3 and 4.

Lockable sliding linkage means 50 is constructed of square tubular material having an inside diameter greater than that of the outside diameter of arm members 33 and 36 which allows lockable sliding linkage means 50 to readily pass over the inner end portions of arm members 33 and 36 respectively.

Although an exemplary embodiment of the invention has been shown and described, many changes, modifications, and substitutions may be made by one having ordinary skill in the art without necessarily departing from the spririt and scope of this invention.

What is claimed is:

1. A lock for use between an abutment member and a slidable member of the type movable along a path between an open position and a closed position comprising:

First arm member means having inner and outer end portions;

a first end element;

means for mounting said outer end portion of said first arm member means on said first end element providing pivotal movement of said first arm member means;

second arm member means having inner and outer end portions;

a second end element;

means for mounting said outer end portion of said second arm member means on said second end element providing pivotal movement of said second arm member means;

a pivotal member having first and second end portions;

means for pivotally connecting said first end portion of said pivotal member to said inner end portion of said first arm member means providing pivotal movement;

means for pivotally connecting said second end portion of said pivotal member to said inner end portion of said second arm member means providing pivotal movement;

lockable slide linkage means having locking means capable of being locked and unlocked;

said lockable slide linkage means having an inside size greater than outside size of said first or second arm member means, said lockable slide linkage means capable of simultaneously encompassing said pivotal member and said inner end portion of said first and second arm member means;

said first arm member means having a slide guide means adjacent said inner end portion being at least the length of said lockable slide linkage means permitting motion of said lockable slide linkage means along said first arm member means;

said slide guide means having inner and outer end portion;

resilient means having first and second end portions;

first resilient restraint means attaching said first end portion of said resilient means to said outer end portion of said slide guide means limiting the amount of movement of said lockable slide linkage means in the direction of the outer end portion of said first arm member means;

second resilient restraint means attaching said second end portion of said resilient means to said lockable slide linkage means at said inner end portion of said slide guide means limiting the amount of overcenter movement of said lockable slide linkage means when sliding member is in the closed position.

2. Pivotal movement as described in claim 1 wherein said pivotal movement is in a vertical plane.

3. Locking means as described in claim 1 wherein said locking means is a slide locking means which, when in the locked position, extends into said second arm member means prohibiting movement of said lockable slide linkage means.

4. Slide locking means as described in claim 3 wherein said slide locking means is a key lock.

5. Resilient means as described in claim 1 wherein said resilient means is a spring means.

6. First arm member means as described in claim 1 wherein said first arm members means is comprised of telescoping arm member.

7. Second arm member means as described in claim 1 wherein said second arm member means is comprised of telescoping arm members.

8. Arm member means as described in claim 1 wherein said arm member means are constructed from the group consisting of square tubular steel, square tubular aluminum and tubular plastic.

9. Lockable slide linkage means as described in claim 1 wherein said lockable slide linkage means is constructed from the group consisting of square tubular steel, square tubular aluminum and tubular plastic.

* * * * *